US006210027B1

(12) United States Patent
Fadel et al.

(10) Patent No.: US 6,210,027 B1
(45) **Date of Patent: *Apr. 3, 2001**

(54) SET OF LEFT AND RIGHT MOTOR VEHICLE HEADLAMPS WITH IMPROVED PHOTOMETRIC PROPERTIES

(75) Inventors: Kamislav Fadel, Pantin; Hector Fratty, Paris, both of (FR)

(73) Assignee: Valeo Vision (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/169,515

(22) Filed: Oct. 9, 1998

(30) Foreign Application Priority Data

Oct. 13, 1997 (FR) ..... 97 12759

(51) Int. Cl.[7] ..... F21V 7/00
(52) U.S. Cl. ..... 362/518; 362/297; 362/346
(58) Field of Search ..... 362/291, 297, 362/346, 459, 487, 507, 516, 517, 518, 519, 520, 521, 522, 235, 341

(56) References Cited

U.S. PATENT DOCUMENTS

| | | | | |
|---|---|---|---|---|
| 1,621,752 | | 3/1927 | Raynolds . | |
| 4,704,661 | | 11/1987 | Kosmatka . | |
| 4,779,179 | | 10/1988 | Oyama et al. . | |
| 5,086,376 | | 2/1992 | Blusseau . | |
| 5,377,086 | * | 12/1994 | Tickner | 362/235 |
| 5,446,638 | * | 8/1995 | Matsuzaki et al. | 362/341 |
| 5,599,085 | * | 2/1997 | Tabata et al. | 362/72 |
| 5,769,525 | * | 6/1998 | Daumueller et al. | 362/66 |
| 6,024,473 | | 2/2000 | Fadel | 362/516 |

FOREIGN PATENT DOCUMENTS

| | | |
|---|---|---|
| 764922 | 5/1934 | (FR) . |
| 2586085 | 2/1987 | (FR) . |
| 2 639 888 | 6/1990 | (FR) . |

OTHER PUBLICATIONS

French Search Report dated Jun. 18, 1998.

* cited by examiner

*Primary Examiner*—Cassandra Spyrou
*Assistant Examiner*—Craig Curtis
(74) *Attorney, Agent, or Firm*—Morgan & Finnegan, LLP

(57) ABSTRACT

A set of left and right motor vehicle headlamps, each headlamp including a reflector associated with a light source and a closure front-glass. In accordance with the invention, the left and right headlamps are respectively adapted to generate horizontally spread left and right illumination beams, each beam having a fuzzy edge on the left and on the right, said edges being asymmetric relative to the axis of the road, the left edge of the left beam being offset angularly to the left relative to the left edge of the right beam, and the right edge of the right beam being offset angularly to the right relative to the right edge of the left beam. Applications include forming homogeneous beams with a wide spread.

17 Claims, 7 Drawing Sheets

SET OF LEFT AND RIGHT MOTOR VEHICLE HEADLAMPS WITH IMPROVED PHOTOMETRIC PROPERTIES

FIELD OF THE INVENTION

The present invention relates generally to headlamps for motor vehicles.

BACKGROUND OF THE INVENTION

The left and right headlamps of a motor vehicle conventionally generate identical beams that are essentially superimposed at a distance from the vehicle.

Accordingly, on a standardized projection screen at a distance of 25 meters the two beams have respective concentration spots with a cumulative effect and the lateral edges of the beams are essentially superimposed.

This applies to the low beam and to the high beam and the superimposition is achieved by virtue of the fact that the optical axes of the reflectors of the two headlamps are both essentially parallel to a longitudinal vertical plane of the vehicle.

FIG. 1 of the accompanying drawings shows the front part of a modern motor vehicle. It should be noted in particular that the bodyshell C and the front-glasses Gg and Gd of the left and right headlamps Pg and Pd are curved and streamlined towards the sides of the vehicle.

As shown, this leads to the use of respective reflectors Mg and Md which are relatively deep on the interior side and relatively shallow on the exterior side. This constraint raises two essential problems. The first is the difficulty of generating at each headlamp a wide horizontal spread towards the opposite side of the road because the depth of the part of the reflector on the interior side can block the propagation of steeply inclined light rays. Another problem is the reduced luminous flux recovered by the reflector because the exterior part of the reflector has a very small depth.

Referring now to FIG. 2, it will be apparent why the geometry of headlamps like those shown in FIG. 1 could make them particularly likely to generate light beams with a wider spread towards the outside than towards the inside, as shown by the paths of the rays represented in FIG. 2.

Accordingly, by tilting the beam from the left headlamp towards the left and the beam from the right headlamp towards the right a wider overall beam would be obtained without encountering the usual design problems that arise on attempting to increase the width of a beam (downward folding of images of the filament if striations are deposited on an inclined front-glass, lack of homogeneity if a plurality of reflector areas generate beam paths with different widths which must be mixed to form the overall beam).

However, and referring now to FIG. 3, a problem that would arise with any such lateral offsetting of the beam would be that the two beams Fg and Fd would mix highly imperfectly and in particular the lateral edge of each beam on the interior side, being near the axis of the road, would cause a marked step (S) in the level of illumination of the overall beam, which is totally undesirable.

An object of the present invention is to mitigate these limitations of the prior art and to provide a pair of motor vehicle left and right headlamps that combine to form a wide beam without causing problems of lack of homogeneity in the combination.

Accordingly to the present invention, there is provided a set of left and right motor vehicle headlamps, each headlamp including a reflector associated with a light source and a closure front-glass, characterized in that the left and right headlamps are respectively adapted to generate horizontally spread left and right illumination beams, each beam having a fuzzy edge on the left and on the right, said edges being asymmetric relative to the axis of the road; in that the left edge of the left beam is offset angularly to the left relative to the left edge of the right beam; and in that the right edge of the right beam is offset angularly to the right relative to the right edge of the left beam.

The following are preferred but non-limiting aspects of a set of headlamps in accordance with the invention:

- the reflector of each headlamp has a plurality of smooth reflecting surface areas juxtaposed laterally to each other and delimited by transition lines of broken slope, at least one of said areas being adapted to spread light horizontally between extrema obtained in the immediate vicinity of said transition lines, and the horizontal spreading extremum of each area varies progressively along the transition line concerned;
- the horizontal generatrices are adapted to assure spreading by divergence;
- the horizontal generatrices of the various areas and the position of their transition lines are such that, from the center towards the lateral edges of the reflector, the horizontal spreading extrema in each area diminish progressively;
- the horizontal spreading with asymmetric edges is assured by a back area of the reflector of each headlamp;
- at least one edge area of each reflector is adapted to generate a beam part essentially concentrated on the axis of the road and the concentrated beam parts generated by the two headlamps are essentially superimposed in front of the vehicle;
- the light source of each headlamp is defined by a lamp mounted axially in a lamp hole in the reflector and the axes of said lamps and said lamp holes of the left and right headlamps are respectively obliquely inclined outwards relative to the longitudinal axis of the vehicle;
- the back area of each reflector is generally symmetrical about the oblique axis of the lamp and the associated lamp hole;
- at least one edge area of each reflector has an essentially parabolic horizontal generatrix with its axis substantially parallel to the longitudinal axis of the vehicle; and
- each reflector is injection molded from a plastics material with a mold removal axis corresponding to the axis of the lamp and of the lamp hole.

The invention finds an application mainly, although not exclusively, in low beam headlamps and fog lamps and where appropriate in widebeam high beam headlamps.

Other aspects, aims and advantages of the present invention will become more apparent on reading the following detailed description of preferred embodiments of the invention given by way of example and with reference to the accompanying drawings.

DESCRIPTION OF THE PREFERRED EMBODIMENTS OF THE INVENTION

Figure 1:
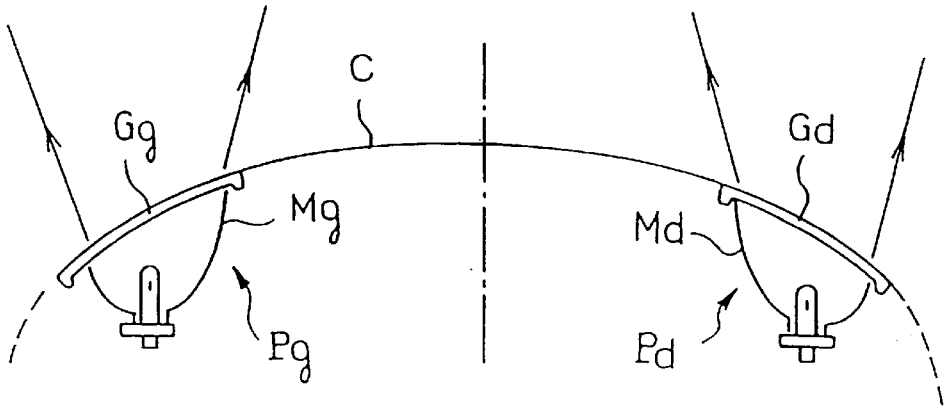
FIG. 1 PRIOR ART
FIG. 1 is a diagram showing a pair of prior art motor vehicle headlamps.
Figure 2:
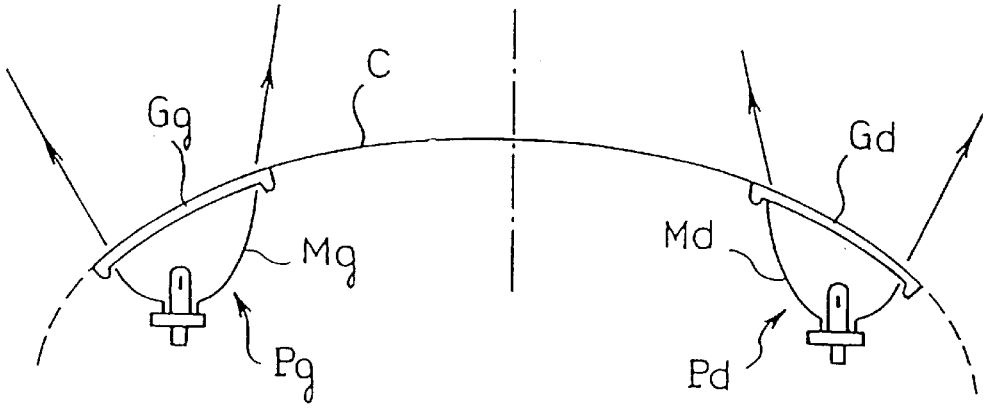
FIG. 2 PRIOR ART
FIG. 2 shows one variant of the same pair of headlamps in terms of the horizontal distribution of light.
Figure 3:
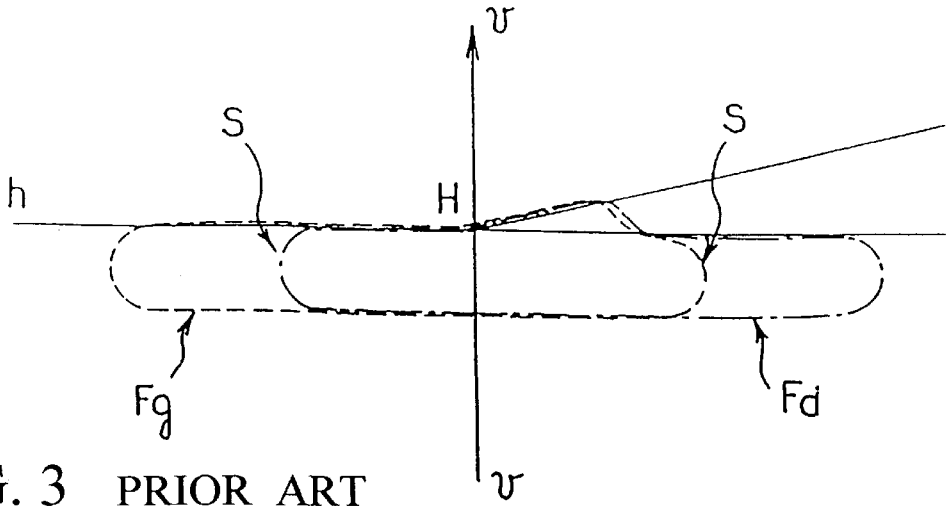
FIG. 3 PRIOR ART
FIG. 3 is a diagram showing the shape of the beams generated on a projection screen by the two headlamps from FIG. 2.
Figure 4:
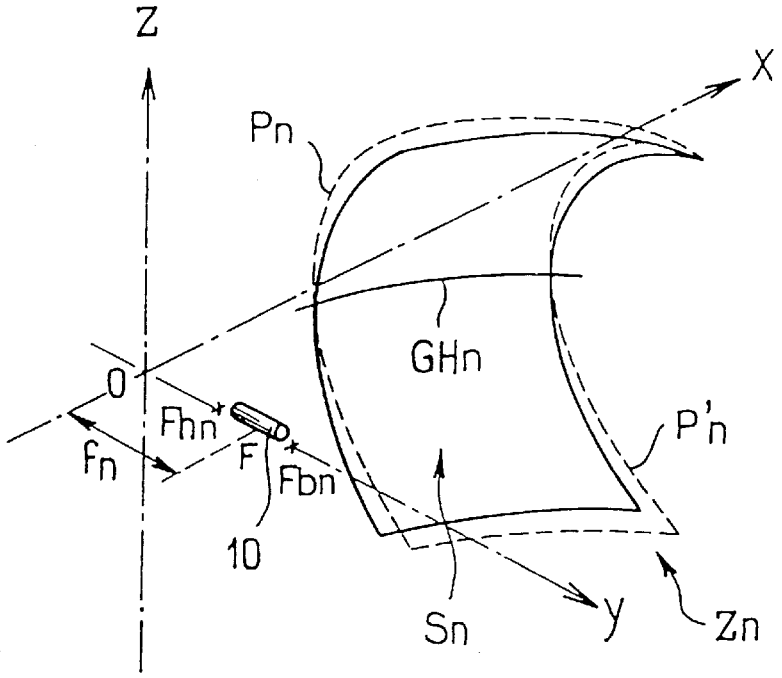
FIG. 4 is a perspective view showing the construction of a headlamp reflector of the present invention.

Referring firstly to FIG. 4, an orthonormal frame of reference is shown, 0X being horizontal and perpendicular to the optical axis, 0Y being the optical axis and 0Z being vertical.

A preferred form of a reflector in accordance with the invention is obtained by individually defining a plurality of reflecting areas juxtaposed laterally to each other, i.e. delimited by a boundary line extending between the top and bottom edges of the reflector.

The reflecting surface Sn of an area Zn of the reflector is generated by first defining in this area a horizontal generatrix GHn designed to assure predetermined lateral spreading of the light and contained between two limits. The horizontal generatrix can be a portion of a hyperbola, a portion of an ellipse or even a straight line segment, etc.

The reflecting surface is built up from this generatrix so that it features a focus offset in vertical section. In the present context focus offset means the variation in the position of the place from which an emitted light ray is reflected in a horizontal plane parallel to the axis 0Y of the reflector. Thus in FIG. 4 the top half of the surface Sn has a "top focus" Fhn different from the focus F of purely parabolic sections Pn, Pn' shown in dashed line for purposes of comparison and its bottom half has a "bottom focus" Fbn which is also different from F. "Top focus offset" means the distance measured along the axis 0Y between the focus F and the "top focus" Fh and "bottom focus offset" corresponds to the distance between F and Fb.

Documents FR-A-2 536 503, FR-A-2 602 305, FR-A-2 609 148, FR-A-2 639 888 and FR-A-2 664 677, all in the name of the Applicant, describe surfaces having the aforementioned focus offset and the skilled person will know how to obtain the necessary information from them.

Accordingly the reflecting surface Sn that will be obtained in the area Zn is a surface capable of generating images of the source (in particular of a generally cylindrical incandescent filament) all of which are situated below a cutoff and which at the same time assures controlled spreading of the images below that cutoff, the horizontal generatrix preferably being chosen so that the spreading is also homogeneous. Moreover, if the focus offset is such that the top and bottom foci Fhn and Fbn of the top and bottom vertical sections of the surface are respectively at the posterior end and at the anterior end of the source, then the images are essentially aligned below and level with the cutoff.

In a limiting case there can be no focus offset, the vertical sections of the surface in this case being parabolas with focus F or a focus that is offset relative to F. This approach can be used in particular for the high beams.

Figure 5:
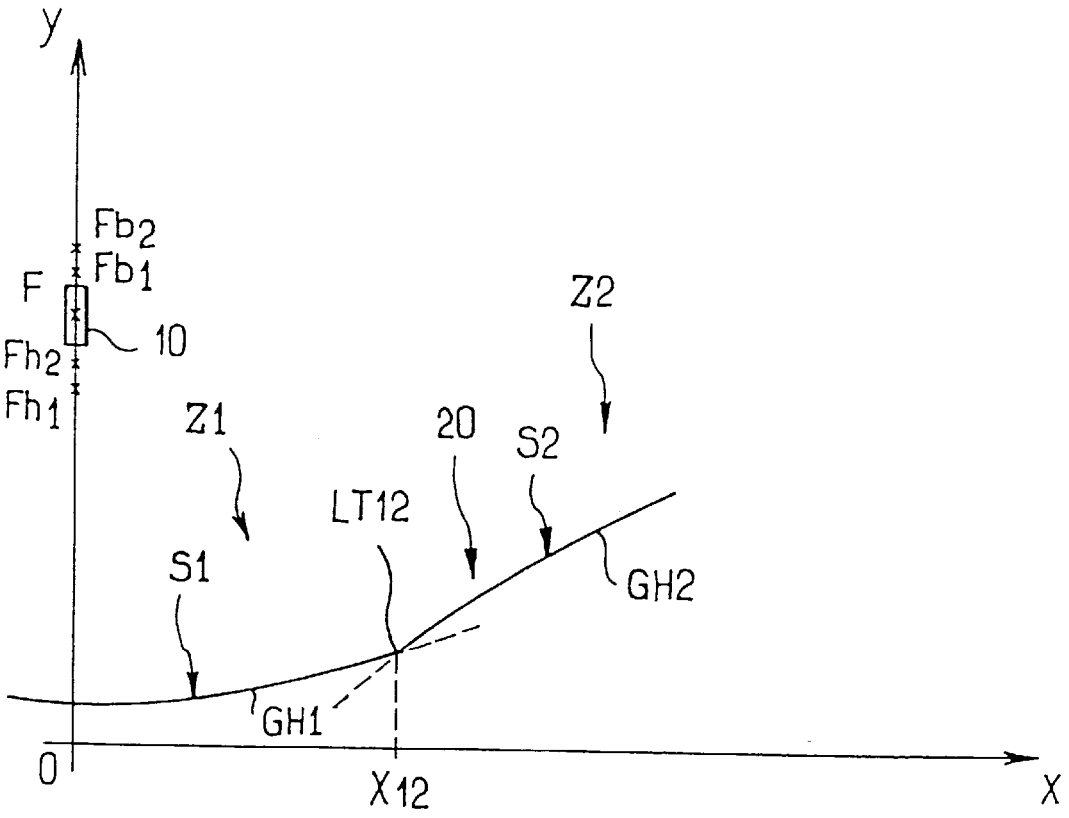
FIG. 5 is a view in horizontal axial section showing part of the reflector obtained.

Referring now to FIG. 5, a reflector in accordance with the invention is constructed in successive steps. Initially an area of the reflector is defined in the fashion explained hereinabove. It is preferably the area at the back of the reflector and the parameters and primarily the shape of the horizontal generatrix and the top and bottom focus offsets of the vertical sections of the reflecting surface are defined in accordance with the size of the reflector and the required photometrics of the wide part of the beam.

Then, in accordance with an essential aspect of the invention, the adjacent areas to the left and to the right of the back area are defined with their own parameters (once again the shape of the horizontal generatrix and the top and bottom focus offsets of its vertical section), on the one hand according to the required position of the light projected by these areas and on the other hand and most importantly so that the reflecting surface of these adjacent areas intersects the reflecting surface of the back area along a transition line that has two essential features:

- firstly, it must extend from top to bottom between the top and bottom edges of the reflector, and
- secondly, the lateral deflection assured by each of the reflecting surfaces at the level of the transition line must not be constant, but to the contrary must vary regularly along the line.

FIG. 5 shows precisely the case in which a reflecting surface S1 is initially defined and is intended to define a back area Z1 of a reflector 20, and its reflecting surface is based on a horizontal generatrix GH1 with appropriate top and bottom focus offsets Fh1 and Fb1.

The reflecting surface S2 of an area Z2 is then defined, this surface being based on a horizontal generatrix GH2 and having top and bottom focus offsets Fh2 and Fb2.

It will be understood that by varying the position of the horizontal generatrix GH2 along the axis 0Y the two reflecting surfaces can be made to intersect in the plane X0Y at a point having a precise coordinate X12 to define a boundary common to the two areas Z1 and Z2 in that plane. Given that the other parameters of the area Z2 remain within reasonable limits, the two areas will in fact intersect along a transition line LT12 passing through the coordinate X12 at the level of the section plane X0Y and joining the top and bottom edges of the reflector.

In accordance with another important aspect of the invention the exact trajectory of the transition line LT between the areas Z1 and Z2 is constructed over the height of the reflector by varying the top and bottom focus offset values in each of those areas.

There are various possible approaches to this, and two main ones:

- the first consists in varying the top and bottom foci Fh and Fb respectively of the top and bottom parts of the reflecting surface so that they have two identical first positions for the whole of one of the areas and two identical second positions, different from the first positions, for the whole of the other area; this allows controlled progressive curving of the transition line LT12 away from the top and towards the bottom of the plane X0Y, towards the left or towards the right when the transition line is viewed projected into the vertical plane X0Z.
- the second approach consists in varying the position of the top and bottom foci not area by area but instead continuously within the same area; as a result, the focus offsets can be adjusted independently of each other in depth in one area relative to the two adjoining areas so that the corresponding transition lines can be curved independently of each other; the evolution of the top and/or bottom foci within the same area is preferably such that the focus offset evolves in a linear fashion as a function of the X coordinate.

It will also be noted that, each transition between areas being achieved by the intersection of two surfaces that are generally not tangential to each other, it does not create any zero order continuity between the reflecting surfaces of the two areas but there is an elbow bend at its level that, when the headlamp is turned off, enables the observer to clearly distinguish the different areas, which is beneficial from the aesthetic point of view.

Note further that, because of the variations induced by the focus offset, the transition line LT12 between the areas Z1 and Z2 will generally follow a more or less curved and sinuous trajectory that has the property of not being coincident with a line of constant lateral deviation of the area Z1 or with a line or constant lateral deviation of the area Z2. As a result the width of each area will vary progressively with the Z coordinate and the maximal lateral spreading at the level of the transition line LT12 will vary progressively on moving along that line. This avoids the phenomenon of sudden blocking of the part of the beam generated by each of the areas of the reflector, which is a standard drawback of reflectors with projected cylindrical striations. In this way a beam with fuzzy lateral edges is generated.

Note moreover that by varying the position of the transition lines that delimit a given area it is easy to favor spreading of the light either towards the left or towards the right, the spreading towards a given side decreasing as the transition line concerned reduces the width of the area along the 0X axis and increasing if the transition line is such that the width of the area increases.

Finally, it is clear that the variation of the top and bottom focus offsets shifts the position of the images of the filament on a projection screen upwards or downwards. When the beam to be formed must conform to a given cutoff, the changes of focus offset are obviously chosen so that this cutoff continues to be complied with and is defined with some degree of sharpness. In other cases this controlled focus offset can be exploited to adjust the distribution of the light in the direction of the thickness of the beam.

The construction of the reflector continues by defining, in the same manner as previously, an area Z3 adjacent the area Z2 with parameters producing an elbowed transition line LT23 extending as far as the required X coordinate in the plane X0Y.

The above steps can be repeated for as many areas as necessary in the left and right parts of the reflector.

The invention can therefore provide a reflector in which different laterally juxtaposed areas can have parameters that generate different beam parts with great flexibility, to facilitate modeling the final beam, whilst producing a reflecting surface with no zero order discontinuities, which are well known to create optical anomalies, and obtaining a surface whose appearance when the headlamp is turned off is that of a reflector with wide curved striations, which is beneficial from the aesthetic point of view.

All of the modeling of the beam preferably being effected at the level of reflector, the front-glass of the headlamp (not shown) can be entirely smooth or comprise only styling elements that are optically inactive or practically so.

For optimum adaptation to the geometry around the headlamp (side cheeks likely to cut off an excessively widened beam, front-glass bottom edge likely to create optical anomalies, etc) the horizontal generatrices of the central areas of the reflector are advantageously such that these areas assure wide spreading of the light to impart the width to the beam by means of large images of the source whereas the lateral areas of the reflector have horizontal generatrices which do not spread the light very much in order to assure the central concentration spot of the beam by means of smaller images of the filament, the intermediate areas assuring an intermediate lateral spreading. In other words, the horizontal generatrices of the various areas are preferably farther away from the parabolas the nearer the area is to the center of the reflector.

Figure 6:
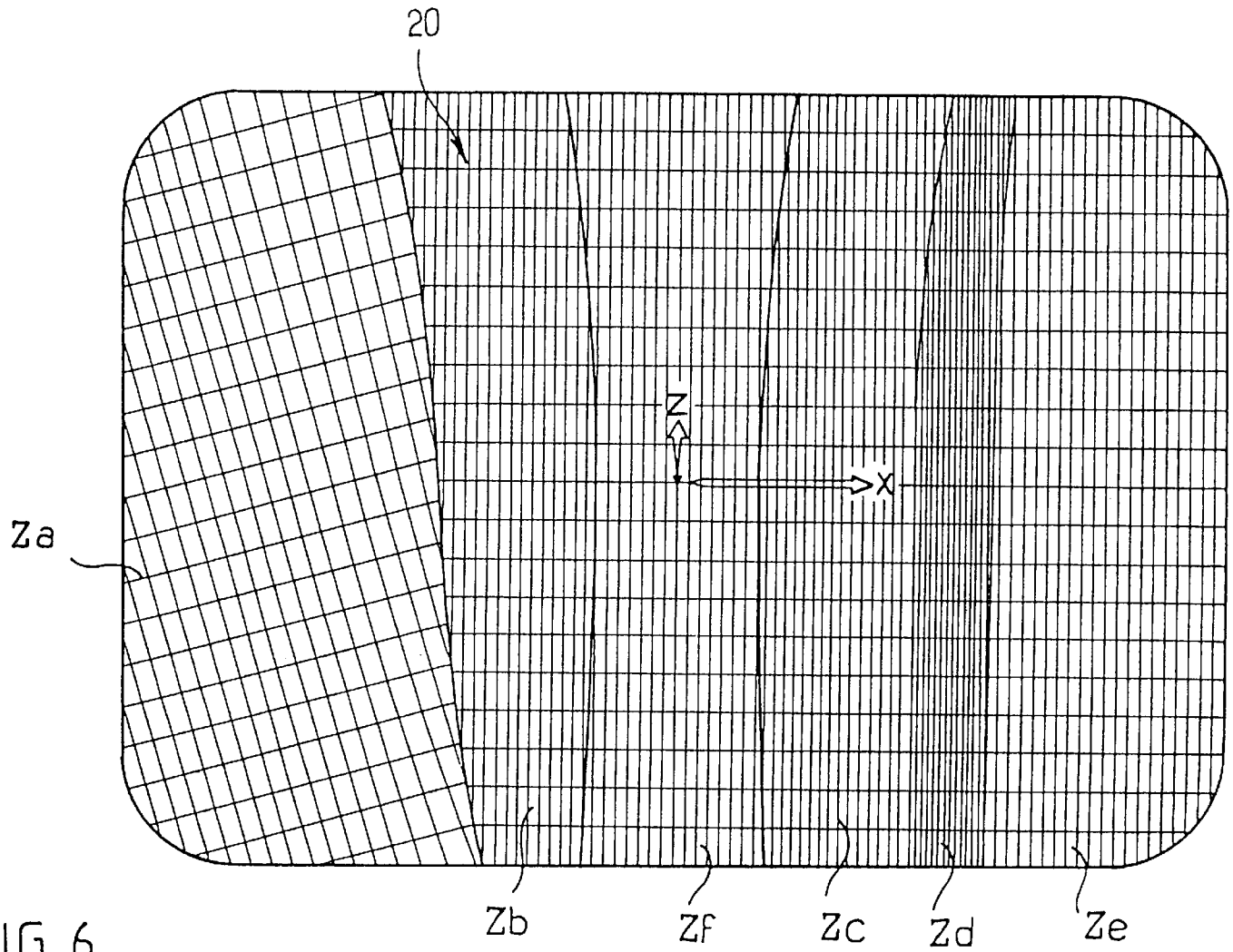
FIG. 6 is a back view of one example of a reflector constructed in accordance with the present invention.

FIG. 6 shows a reflector of a European low beam headlamp in accordance with the present invention for driving on the right.

It has six areas designed as described hereinabove, namely, from left to right:

- a left edge area Za the surface of which is such that it is capable of aligning the images of the source below and level with a cutoff inclined at 15° above the horizontal,
- a first intermediate area Zb,
- a back area Zf,
- a second intermediate area Zc,
- two edge areas Zd and Ze.

The areas Zb through Zf have surfaces capable of placing the images of the filament below and near a non-inclined cutoff.

Note that the method used to construct the left edge area Za differs from the method used to construct the other areas simply by rotating the orthonormal frame of reference employed by 15°.

In this embodiment the lateral spreading assured by the various areas decreases as the distance of the area from the optical axis increases.

In accordance with an important aspect of the present invention, a spreading of the light that is not symmetrical about the axis 0Y of the headlamp is achieved with at least one area of the reflector, preferably with the back area Zf.

Figure 7:
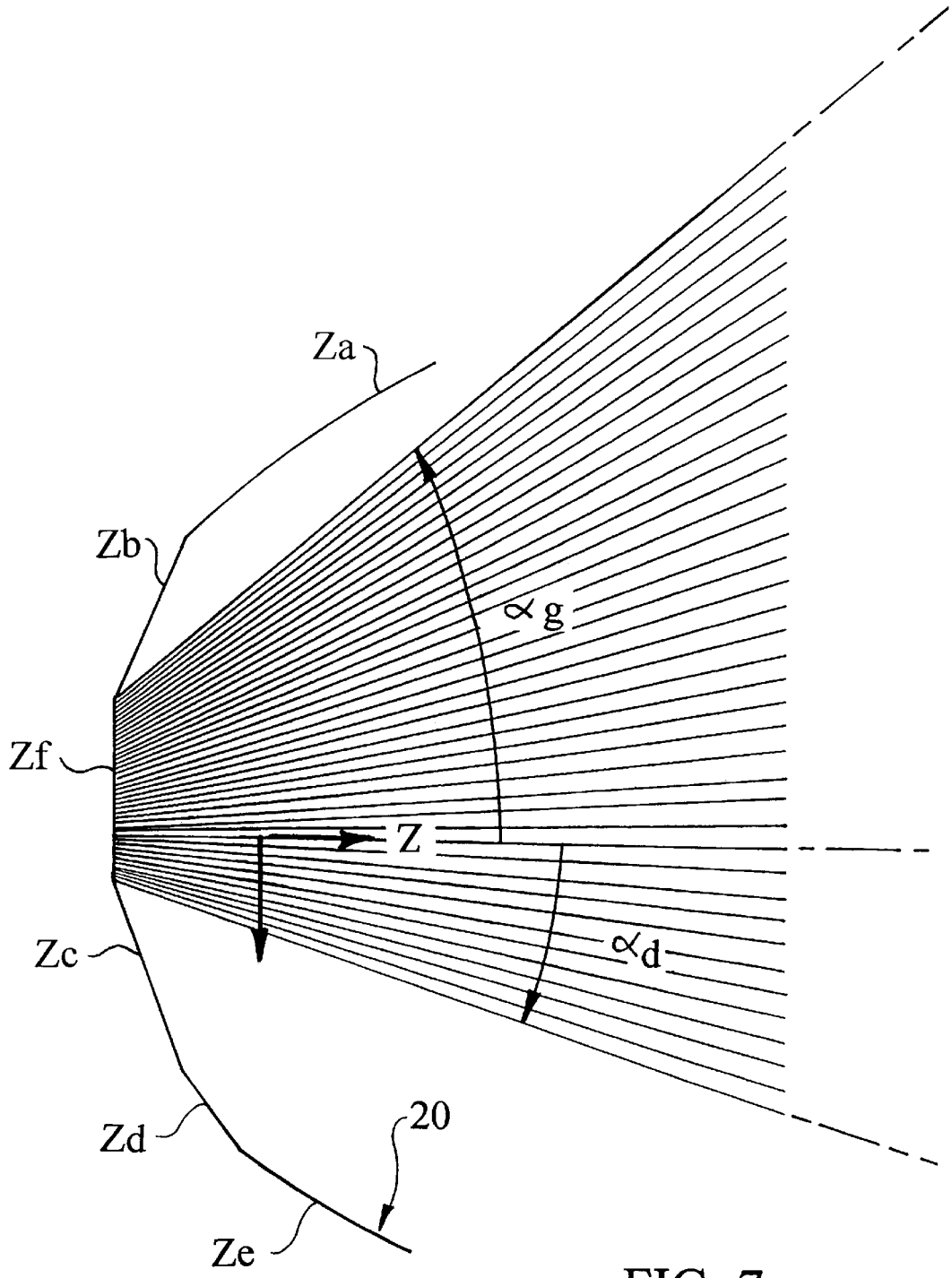
FIG. 7 is a view projected into the horizontal plane showing the optical behavior of a central area of a reflector constructed in accordance with the present invention.

Accordingly FIG. 7 shows the situation for a left headlamp in which the lateral spreading assured by the area Zf is such that a maximal lateral deviation to the left (angle $\alpha_g$) is significantly greater than the maximal lateral deviation to the right (angle $\alpha_d$). By virtue of the specific design of the reflector, it will be understood also that the area Zf will generate a wide beam part with fuzzy lateral edges.

Figure 8:
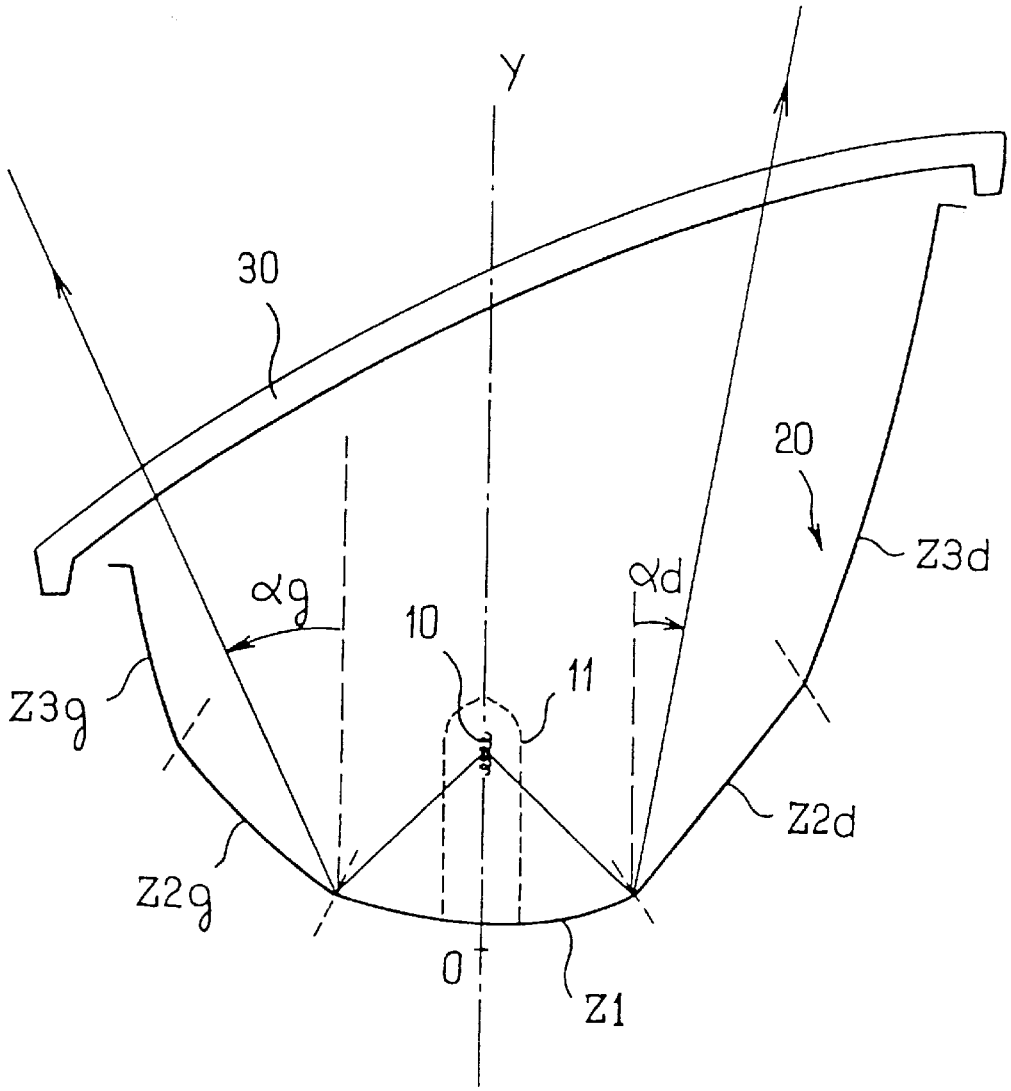
FIG. 8 is a diagrammatic view in horizontal axial section of a left headlamp constituting a first embodiment of the present invention.

FIG. 8 shows a first specific embodiment of a left headlamp of a pair of headlamps in accordance with the invention.

It comprises a lamp 11 with a filament 10, a reflector 20 and a highly oblique front-glass 30 merging into the curvature of the front end of the vehicle.

The reflector 20, made as described previously, has a back area Z1 adapted to achieve wide lateral spreading of the light between different angular limits $\alpha_g$ and $\alpha_d$, two intermediate areas Z2g and Z2d achieving intermediate lateral spreading symmetrical about 0Y or not, and finally two edge areas Z3g and Z3d generating relatively concentrated light on the axis and at least one of which, preferably the larger area Z3d, is adapted to produce a beam part below the inclined half-cutoff of the standardized European beam, as described above.

This reflector design improves the complementarity of the reflector and the front-glass, the light exit window of which is very open towards the side.

The right headlamp (not shown) is designed on the same principle and differs from the left headlamp essentially in that the back area Z1 of its reflector, and possibly the intermediate areas Z2g, Z2d, achieves lateral spreading of the light that is still asymmetric about the axis 0Y but emphasizing spreading towards the right side. Another difference between the left headlamp and the right headlamp can consist in generating a beam part delimited by the inclined half-cutoff by the area Z3d in the left headlamp and the area Z3g, which is wider than the area Z3d, in the right headlamp.

Figure 9:
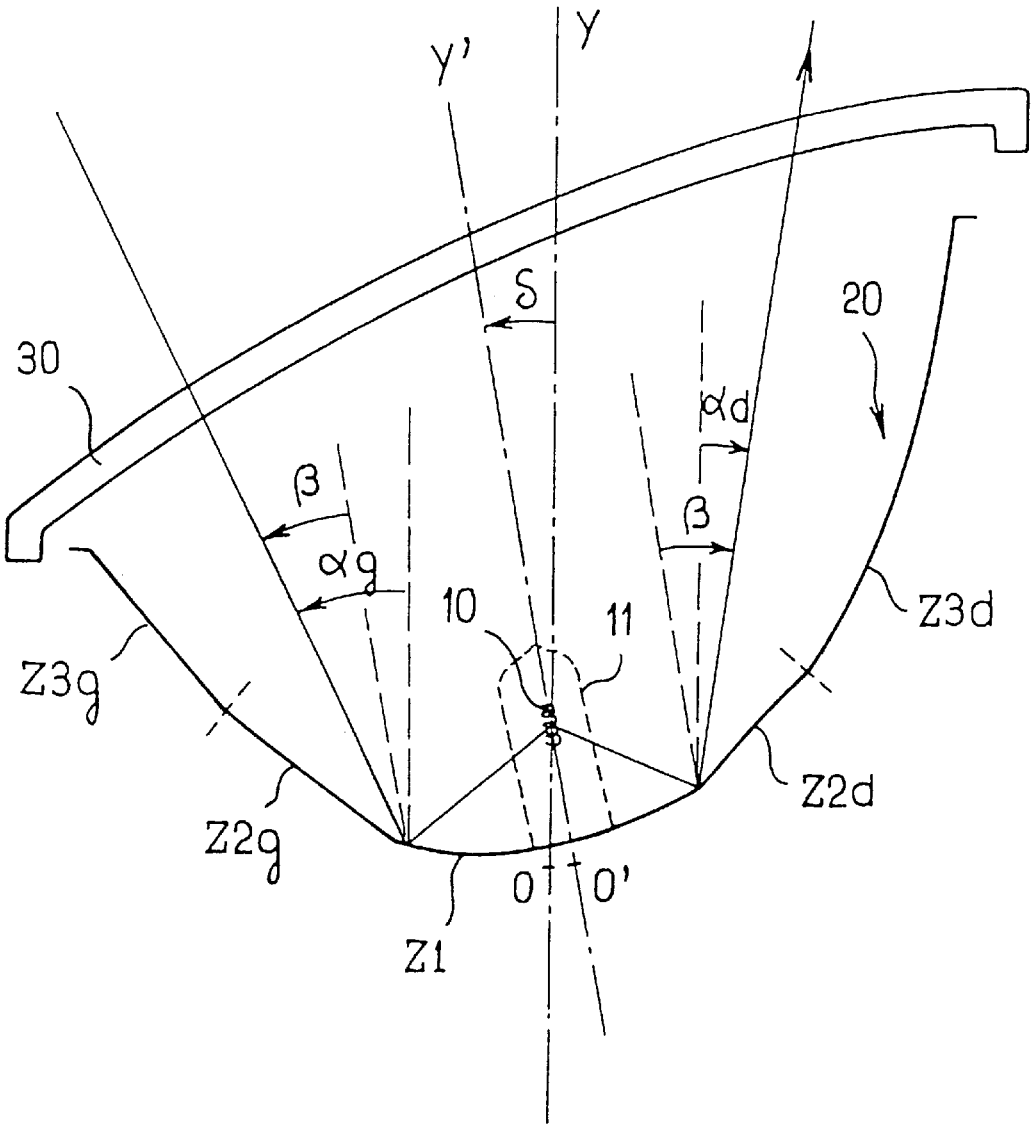
FIG. 9 is a diagrammatic view in horizontal axial section of a left headlamp constituting a second embodiment of the present invention.

FIG. 9 shows another specific embodiment of a left headlamp in accordance with the present invention.

In this case the reflector has a main axis 0'Y' and a secondary axis 0Y.

The main axis 0'Y' is slightly oblique to the side, as shown, and the lamp 11 is mounted in the reflector on the main axis.

Accordingly, if a back area Z1 is formed that is symmetrical about the oblique axis 0'Y' (for which it is sufficient to utilize this axis as the reference axis in designing the surface) then the lateral spreading that it will generate will be asymmetric about the axis 0Y, which is the required aim.

To be more precise, $\delta$ designating the inclination of the axis 0'Y' to the axis 0Y and $\beta$ designating the half-angle of the horizontal spreading assured relative to the axis 0'Y' of the area Z1, the lateral spreading relative to the axis of the road will be:

to the left, $\alpha_g=\beta+\delta$, to the right, $\alpha_d=\beta-\delta$.

The areas of Z3g and Z3d are constructed using a frame of reference in which the axis 0Y is the reference axis, with essentially parabolic horizontal generatrices with axis 0Y to enable them to generate concentrated light on the axis.

In this case the intermediate areas Z2g and Z2d can be constructed either from the axis 0'Y' or from the axis 0Y, or even from an oblique intermediate axis.

Note that the oblique position of the axis 0'Y' along which the lamp is oriented, which determines the direction in which the reflector is removed from the mold when it is molded from a plastics material (typically a thermosetting plastics material), is particularly advantageous in the case of strongly inclined front-glasses to which the present invention applies.

To be more precise, and in particular if short focal lengths are used in designing the reflector in order to recover the maximum luminous flux, the part of the reflector on the interior side of the vehicle, which is deeper, normally has at the end near the front-glass a relatively small inclination relative to the axis of a lamp disposed in the conventional fashion. This slight inclination can cause problems with removing the reflector from the mold in which it is manufactured given that the direction in which the mold is moved will not be greatly inclined to the surface generated by the mold in the region concerned.

By orienting the axis of the lamp as shown in FIG. 9, the aforementioned difficulty is significantly reduced because the inclination of the part of the reflector causing the problem relative to the direction of removal from the mold is increased by this means.

Figure 10:
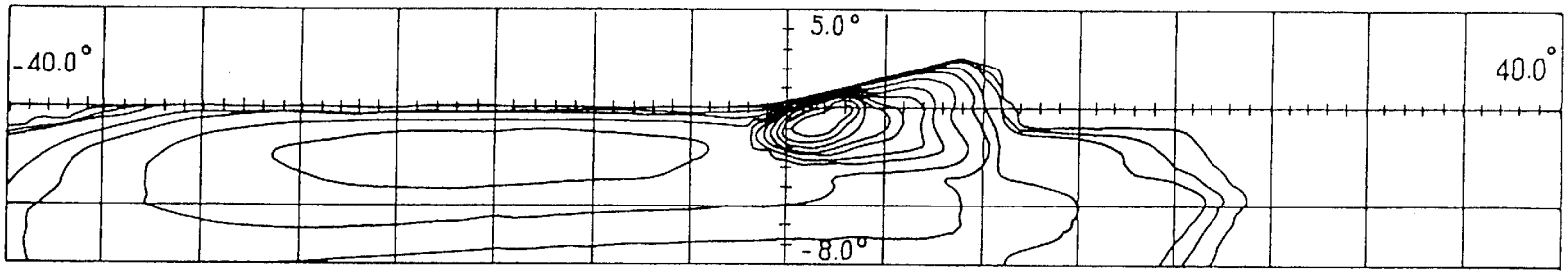
FIG. 10 is a set of isocandela curves showing the optical behavior of a left headlamp of the invention.
Figure 11:
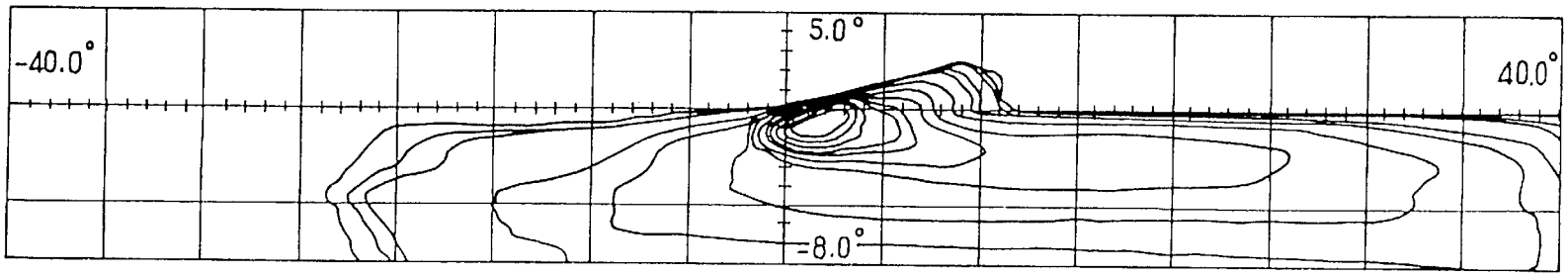
FIG. 11 is a set of isocandela curves showing the optical behavior of a right headlamp of the invention.

FIGS. 10 and 11 each show by means of a respective set of isocandela curves the shapes of the beams respectively generated by a left headlamp and a right headlamp of the invention.

Note that because of the external areas of the reflector each beam has a concentration spot substantially on the axis of the road and good definition of the standardized "V" cutoff hHc in this region.

Note also that the wide part of the beam has a different lateral spread in each case, the left headlamp illuminating more to the left and the right headlamp illuminating more to the right.

Note above all else, however, that the lateral edges of this wide part of the beam feature a wide spacing between the successive isocandela curves, which corresponds to a very progressive reduction of illumination with the horizontal spreading angle. This is why mention has been made of "fuzzy edges". (In this regard, note that the spreading angles mentioned above in describing the headlamps from FIGS. 8 and 9 are of course not angles beyond which the light is suddenly cutoff, but the angles achieved by the fuzzy edges, measured for a given illumination).

Figure 12:
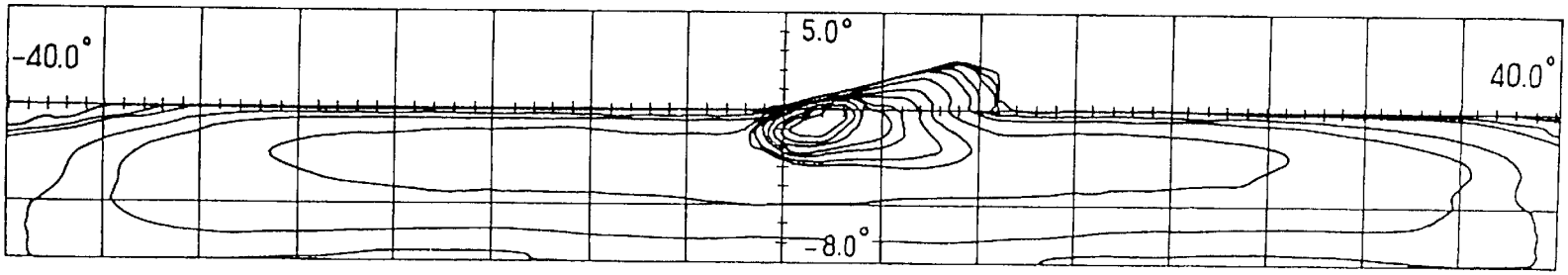
FIG. 12 is a set of isocandela curves showing the optical behavior of the set of left and right headlamps of the invention.

Accordingly, the two beams will be able to mix ahead of the vehicle with good superimposition of the cutoffs and the concentration spots of the two beams and with entirely acceptable homogeneity of the wide part of the beam, as shown in FIG. 12 which shows the overall beam generated by the two headlamps.

Another advantage of the overall beam obtained is that its lateral edges are also fuzzy, which avoid disturbances in the peripheral vision of the human eye.

Note also that the part of the beam along the half-cutoff Hc is not extended excessively far along this half-cutoff, which correctly illuminates the side of the road without dazzling the drivers of vehicles being overtaken by reflection in their external rear view mirrors, which is a standard problem in beams with a "V" cutoff.

It will be understood that the invention applies with benefit to all situations in which the beam emitted must be relatively widely spread in the widthwise direction (mainly low beams, fog lamp beams and where appropriate main beams).

What is claimed is:

1. A set of left and right motor vehicle headlamps, each headlamp including a single-piece reflector associated with a light source and a closure front-glass, in which the left and right headlamps are respectively adapted to generate horizontally spread left and right illumination beams, each beam having a fuzzy edge of the left and on the right, said edges being asymmetric relative to the axis of the road, wherein the left edge of the left beam is offset angularly to the left relative to the left edge of the right beam, and the right edge of the right beam is offset angularly to the right relative to the right edges of the left beam.

2. A set of left and right headlamps according to claim 1, wherein the reflector of each headlamp has a plurality of smooth reflecting surface areas juxtaposed laterally to each other and delimited by transition lines of broken slope, at least one of said area being adapted to spread light said beams horizontally between extrema obtained in the immediate vicinity of said transition lines, and wherein the horizontal spreading extremum of each area varies progressively along the transition line concerned.

3. A set of left and right headlamps according to claim 2, wherein the plurality of smooth reflecting surface areas having horizontal generatrices defined therein, said horizontal generatrices adapted to assure spreading of beams by divergence.

4. A set of left and right headlamps according to claim 3, wherein the horizontal spreading extrema in each area diminish progressively from the center towards the lateral edges of the reflector.

5. A set of left and right headlamps according to claim 1, wherein the horizontal spreading with asymmetric edges is assured by a back area of the reflector of each headlamp.

6. A set of left and right headlamps according to claim 5, wherein at least one edge area of each reflector is adapted to generate a beam part essentially concentrated on the axis of the road, and the concentrated beam parts generated by the two headlamps are essentially superimposed in front of the vehicle.

7. A set of left and right headlamps according to claim 1, wherein the light source of each headlamp is defined by a lamp mounted axially in a lamp hole in the reflector, and the axes of said lamps and of said lamp holes of the left and right headlamps are respectively obliquely inclined outwards relative to the longitudinal axis of the vehicle.

8. A set of left and right headlamps according to claim 5, wherein the light source of each headlamp is defined by a lamp mounted axially in a lamp hole in the reflector, and the axes of said lamps and of said lamp holes of the left and right headlamps are respectively obliquely inclined outwards relative to the longitudinal axis of the vehicle, and the back area of each reflector is generally symmetrical about the oblique axis of the lamp and the associated lamp hole.

9. A set of left and right headlamps according to claim 7, wherein at least one edge area of each reflector has an essentially parabolic horizontal generatrix with its axis substantially parallel to the longitudinal axis of the vehicle.

10. A set of left and right headlamps according to claim 7, wherein each reflector is injection molded from a plastics material with a mold removal axis corresponding to the axis of the lamp and of the lamp hole.

11. A set of left and right headlamps according to claim 1, comprising low beam headlamps.

12. A set of left and right headlamps according to claim 1, comprising fog lamps.

13. A set of left and right headlamps according to claim 2, wherein the transition lines extend vertically from top to bottom edges of the reflector.

14. A set of left and right headlamps, each headlamp comprising a single-piece reflector associated with a light source and a closure front-glass, said reflector having central, lateral and intermediate smooth reflecting surface areas juxtaposed laterally to each other, said smooth reflecting surface areas having horizontal generatrices defined therein, said horizontal generatrices of the central areas of the reflector are configured to provide wide spreading of said beams, said horizontal generatrices of the lateral areas of the reflector are configured to centrally concentrate the beam into a spot, and said horizontal generatrices of the intermediate areas of the reflector are configured to provide intermediate lateral spreading of the beam.

15. A set of left and right headlamps according to claim 14, wherein the transition lines extend vertically from top to bottom edges of the reflector.

16. A set of left and right headlamps according to claim 8, wherein the axes are obliquely inclined at approximately 15°.

17. A set of left and right motor vehicle headlamps, each headlamp including a single-piece reflector associated with a light source, in which the left and right headlamps are respectively adapted to generate a left and a right illumination beam that are horizontally spread from light received from the light source, wherein each said beam has a fuzzy edge on the left and on the right, said edges being asymmetric relative to the axis of a road, and wherein the left edge of the left beam is offset angularly to the left relative to the left edge of the right beam, and the right edge of the right beam is offset angularly to the right relative to the right edge of the left beam.

* * * * *